United States Patent [19]

Eckard et al.

[11] 4,252,003

[45] Feb. 24, 1981

[54] REDUCED POWER CONSUMPTION AIR CONDITIONING

[75] Inventors: Spurgeon E. Eckard, Bryn Mawr, Pa.; James A. Bond, Ballston Lake, N.Y.

[73] Assignee: General Electric Company, Philadelphia, Pa.

[21] Appl. No.: 62,055

[22] Filed: Jul. 30, 1979

[51] Int. Cl.[3] ..... F25D 23/00

[52] U.S. Cl. ..... 62/271; 62/93

[58] Field of Search ..... 62/92, 93, 271, 510

[56] References Cited

U.S. PATENT DOCUMENTS

| | | | |
|---|---|---|---|
| 2,018,804 | 10/1935 | Rasmusen | 62/93 |
| 2,155,484 | 4/1939 | Gottlieb | 62/510 |
| 2,222,240 | 11/1940 | Philipp | 62/93 |
| 3,119,239 | 1/1964 | Sylvan | 62/93 |
| 4,196,526 | 4/1980 | Berti | 62/93 |

*Primary Examiner*—Ronald C. Capossela

*Attorney, Agent, or Firm*—Allen E. Amgott; Raymond H. Quist

[57] ABSTRACT

In lieu of passing all air to be conditioned over an evaporator coil which is cold enough to cause a substantial amount of water vapor to condense; only a portion of the air is cooled to this extent. The remaining air is cooled to a higher temperature (at which negligible water vapor condenses). The total work to recompress the vaporized refrigerant is thereby reduced.

4 Claims, 5 Drawing Figures

REDUCED POWER CONSUMPTION AIR CONDITIONING

BACKGROUND OF THE INVENTION

This invention relates generally to the removal of sensible and latent heat from air and more particularly to methods and means to do so while minimizing the consumption of energy.

The hoary expression: "It ain't the heat, it's the humidity", reflects the failure of the body to cool itself by perspiring on humid days. Conventional air conditioning apparatus passes all the air to be conditioned over a cool evaporator coil [ordinarily at 4.4°-7.2° C. (40°-45° F.)] not only reducing the air temperature (sensible heat removal), but also causing a substantial part of the water vapor (or latent heat) to be removed as condensation. The latter is often accomplished too well, resulting in excessively dry air whether required for comfort or not.

This excessively dry air is indicative of excessive consumption or waste of energy. That is, when the sensible heat is brought to a desired level, the humidity is lower than necessary, and it requires the expenditure of energy to achieve this undesired extra low humidity.

It has been reported that even at a relatively high dry bulb temperature of 25.5° C. (78° F.) the vast majority of people will be fairly comfortable when the relative humidity is as high as 60 to 70 percent.

SUMMARY OF THE INVENTION

The evaporator coil at the low temperature required to remove latent heat from the air, i.e. water vapor, is only used with a portion of the total air to be conditioned. The remaining air is cooled to remove sensible heat by an evaporator coil at a higher temperature. Less total work is therefore involved in recompressing the vaporized refrigerant.

DESCRIPTION OF THE PREFERRED EMBODIMENT

The overriding concept of this invention is that if moisture is removed from only a part of air to be conditioned instead of from all the air, then the evaporator coil used to cool the air need not be at as low a temperature. For example, the air to be conditioned would be passed over an evaporator coil containing refrigerant fluid at about 15.5°-18.3° C. (60°-65° F.). A portion of the air would then be exposed to an auxiliary evaporator coil at a lower temperature of about (40°-45° F.). A relative humidity sensor would determine when water vapor removal is required.

Figure 1:
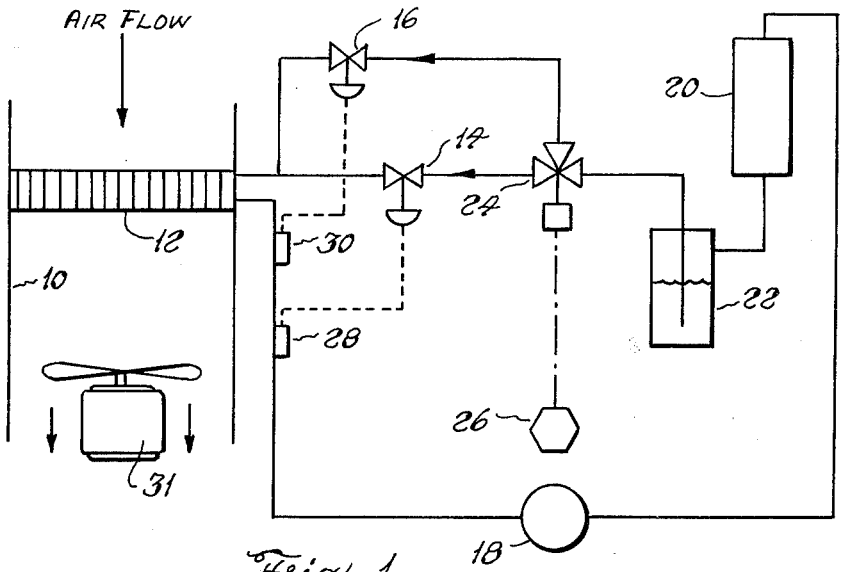
FIG. 1 is a schematic of a first embodiment of an air conditioning system in accordance with the invention.

Referring to FIG. 1, duct 10 is shown containing evaporator coil 12. Refrigerant fluid is passed through evaporator coil 12 from either expansion valve 14 or expansion valve 16. Expansion valve 14 expands the liquid refrigerant to a vapor at a lower pressure than expansion valve 16. Thus vapor from valve 14 is at about 4.4°-7.2° C. (40°-45° F.) while that from valve 16 is at about 15.5°-18.3° C. (60°-65° F.). Compressor 18 operates in the conventional manner to recompress the expanded vapor. (The compressor may be variable speed (dual speed) for capacity modulation.) The vapor is condensed to a liquid in condenser 20 and is conveyed to receiver 22. Two way valve 24 is controlled by humidity sensor 26 to direct the liquid refrigerant to either valve 14 or 16. Pressure/temperature sensors 28 and 30 are associated with expansion valves 14 and 16 respectively. Air flow-rate over the evaporator coil may also be modulated by variable speed blower 31 to assist with evaporator temperature control.

In operation, the thermostat in the space to be cooled is set at the desired temperature in a conventional manner, and humidity sensor 26 is set to the desired relative humidity. As long as the relative humidity remains below the desired value, humidity sensor 26 will command valve 24 to direct liquid refrigerant to expansion valve 16. Since valve 16 does not expand the refrigerant to as low a pressure as valve 14, compressor 18 does less work in recompressing the vapor which results in an energy saving. Only when the humidity increases above the desired level does humidity sensor 26 command valve 24 to direct liquid refrigerant to expansion valve 14. The colder temperature of the vapor from this valve causes increased removal of water vapor or latent heat from the air passing over evaporator 12 and through duct 10.

The system of FIG. 1 consequently only removes latent heat at an accelerated rate at intervals and during the remainder of the time works primarily at reducing sensible heat requiring less work by the compressor.

Figure 2:
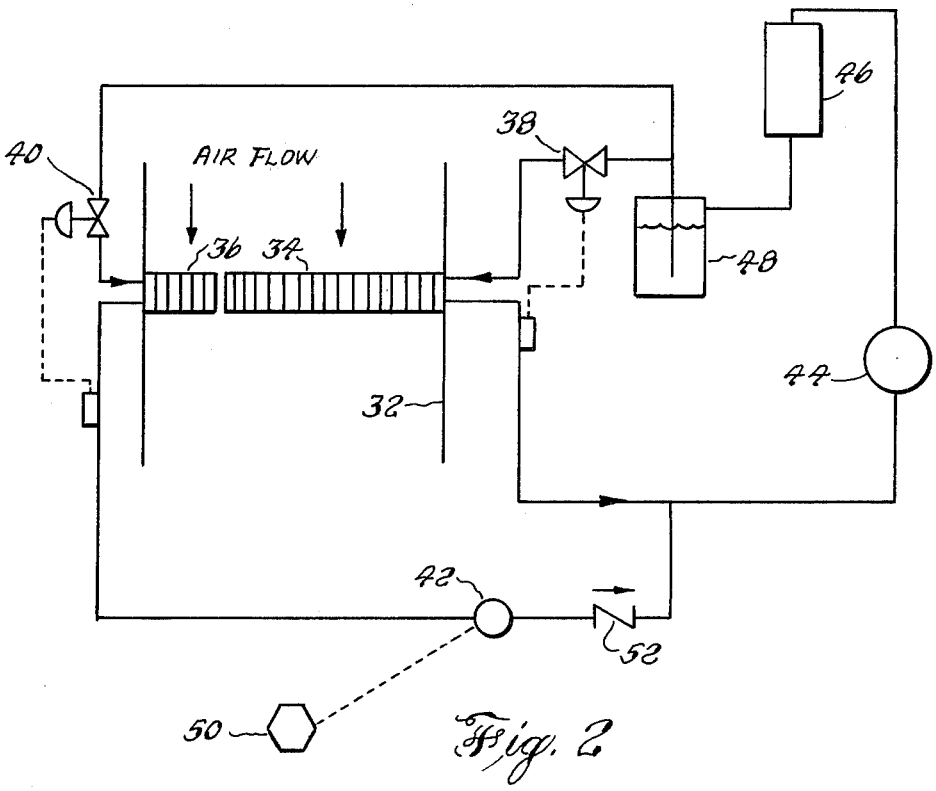
FIG. 2 is a schematic of a second embodiment of an air conditioning system in accordance with the invention.

Referring next to FIG. 2, duct 32 is shown containing two evaporator coils. Large coil 34 is the sensible heat coil, while smaller coil 36 is the latent heat coil. Liquid refrigerant is delivered to expansion valve 38 associated with sensible heat evaporator coil 34, and is also delivered to expansion valve 40 associated with latent heat evaporator coil 36. Boost compressor 42 is provided to raise the pressure of the vapor leaving latent heat coil 36 to the same as that vapor leaving sensible heat coil 34. The vapor then goes to main compressor 44, condenser 46 and receiver 48. By using two evaporator coils only a fraction of the total air is cooled to the point where a substantial part water vapor is removed as opposed to the conventional systems where all air passing through the duct is so cooled. Therefore, the system of FIG. 2 also minimizes total compressor work.

The FIG. 2 system may operate as just described or may be modified. Humidity sensor 50 may be used to control boost compressor 42 so that it will only operate when relative humidity is higher than desired. Check valve 52 prevents any higher pressure vapor from leaking back to the latent heat circuit.

Figure 3:
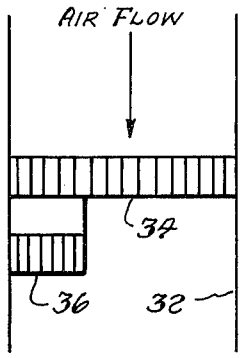
FIG. 3 is a schematic of a first modification of the FIG. 2 embodiment.

As shown in FIG. 3, the two evaporator coils 36 and 34 of FIG. 2 can be alternatively placed in a series configuration in duct 32.

Figure 4:
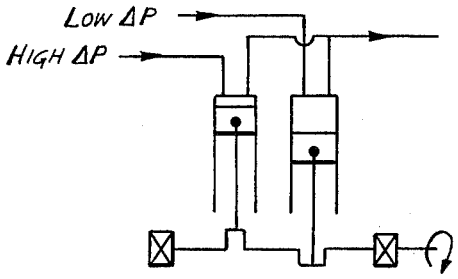
FIG. 4 is a schematic of a second modification of the FIG. 2 embodiment.

In addition, as shown in FIG. 4, in lieu of two separate compressors, separate cylinders of the same compressor can be used to recompress the low and higher pressure vapors to the same pressure.

Figure 5:
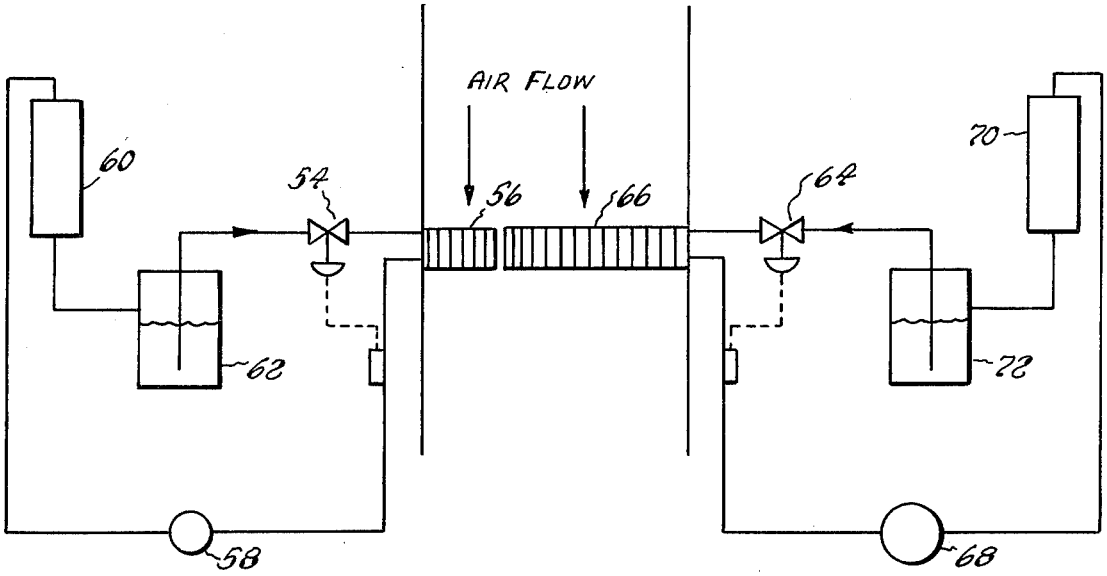
FIG. 5 is a schematic of a third embodiment of an air conditioning system in accordance with the invention.

Turning now to FIG. 5, parallel refrigeration systems are shown. The primary system, which is conventional, includes expansion valve 54, latent heat evaporator coil 56, compressor 58 (driven by an electric motor), condenser 60 and receiver 62. The secondary system includes expansion valve 64, sensible heat evaporator coil 66, compressor 68 (driven by a Rankine cycle engine or a second electric motor), condenser 70 and receiver 72. By using the sensible heat coil wherein the refrigerant vapor is at a relatively higher temperature and pressure than the latent heat coil, a Rankine engine powered with motive fluid vapor heated by a solar energy collector can be effectively employed to drive the compressor.

It should be recognized that water vapor removal will generally not remove all water vapor, but rather a substantial portion. Also, while particular temperature ranges are given which appear to be the most desirable, other temperatures can be used to achieve a similar result.

Although particular embodiments of systems for conditioning air and methods of so doing have been illustrated and described, it will be obvious that changes and modifications can be made without departing from the spirit of the invention and the scope of the appended claims.

I claim:

1. In an air conditioning system for selectively removing sensible and latent heat from air, the improvement comprising:

duct means for conveying the air to be conditioned;

means for moving air through said duct means:

a first evaporator coil positioned in said duct means so that at least a portion of the air will pass over it;

said first coil adapted to be cooled to a temperature low enough to remove sensible heat from said air but only negligible amounts of latent heat;

a first compressor for recompressing vapor evaporated in said first evaporator coil;

a second evaporator coil positioned in said duct means so that at least a portion of the air will flow over it;

said second coil adapted to be cooled to a temperature low enough to remove substantial amounts of latent heat; and a second compressor for recompressing vapor evaporated in said second evaporator coil;

whereby latent heat will only be removed in substantial quantities when said second compressor is operated.

2. An air conditioning system in accordance with claim 1 wherein:

said second coil is cooled to a temperature 25 to 40% lower than said first coil.

3. An air conditioning system in accordance with claim 1 wherein:

the pressure of the vapor leaving said second compressor is the same as that vapor entering the first compressor and the two vapors are combined before entering the first compressor.

4. An air conditioning system in accordance with claim 1 wherein:

said first compressor is driven by a Rankine cycle engine and said second compressor is driven by an electric motor.

* * * * *